US007115052B2

(12) United States Patent
Wardle et al.

(10) Patent No.: US 7,115,052 B2
(45) Date of Patent: Oct. 3, 2006

(54) METHODS AND DEVICES FOR SPORT BALL TRAINING

(75) Inventors: John L. Wardle, San Clemente, CA (US); James M. Jensen, San Clemente, CA (US)

(73) Assignee: Pro Tennis Training, Inc., San Clemente, CA (US)

( * ) Notice: Subject to any disclaimer, the term of this patent is extended or adjusted under 35 U.S.C. 154(b) by 0 days.

(21) Appl. No.: 10/895,534

(22) Filed: Jul. 21, 2004

(65) Prior Publication Data

US 2005/0113193 A1 May 26, 2005

Related U.S. Application Data

(60) Provisional application No. 60/517,935, filed on Nov. 5, 2003, provisional application No. 60/489,959, filed on Jul. 23, 2003.

(51) Int. Cl.
*A63B 69/38* (2006.01)

(52) U.S. Cl. ..... 473/459; 473/423; 473/429; 473/430

(58) Field of Classification Search ..... 473/422, 473/423, 426, 429, 430, 451, 459, 417, 418
See application file for complete search history.

(56) References Cited

U.S. PATENT DOCUMENTS 1,441,221 A 1/1923 Fourcher
2,219,732 A * 10/1940 Armstrong ..... 473/388
3,166,317 A 1/1965 Tumelson
3,227,450 A * 1/1966 Pruitt ..... 473/426
3,351,343 A * 11/1967 Papp ..... 473/430
3,397,885 A 8/1968 Nash
3,477,717 A 11/1969 Clark
3,540,726 A 11/1970 Davis
3,876,203 A 4/1975 Gold
3,893,669 A 7/1975 Myers
4,050,694 A * 9/1977 Domroski ..... 473/429
4,089,521 A 5/1978 Berst et al.
4,105,203 A 8/1978 Cho
4,191,372 A 3/1980 Keller
4,460,172 A 7/1984 Hogan
5,082,262 A 1/1992 Sanchez
5,184,816 A 2/1993 Lunsford
5,282,615 A * 2/1994 Green et al. ..... 473/418

(Continued)

OTHER PUBLICATIONS

Web page printout, Eagnas Tennis Trainer, www.eagnas.com/trainer.html, 2 pages, retrieved Nov. 18, 2003.

Web page printout, PracticeHit Stroke Trainer, www.tennis-balls.com/cgi-bin/tennis training aids, 1 page, retrieved Dec. 9, 2003.

(Continued)

*Primary Examiner*—Raleigh W. Chiu
(74) *Attorney, Agent, or Firm*—BioTechnology Law Group

(57) ABSTRACT

Sport ball training devices and methods for releasably holding a tennis ball or other sport ball at an appropriate height for the practice of striking the ball, either directly or indirectly with a racket or the like. An embodiment may have a support device with a base and an adjustable vertical tubular assembly for the support of a transverse arm from which a ball sling is suspended. A retainer member of the ball sling circumferentially holds a sport ball. An embodiment of the retainer member may be made from an elastometric material that lightly squeezes the ball with sufficient force to restrain it, but releases easily when the ball is hit so that the trajectory of the ball is not affected by the presence of the retainer member nor is the racquet significantly affected by the presence of the ball sling generally.

47 Claims, 14 Drawing Sheets

U.S. PATENT DOCUMENTS

| | | | | |
|---|---|---|---|---|
| 5,344,138 | A | 9/1994 | Hellriegel | |
| 5,593,155 | A | 1/1997 | Fauble et al. | |
| 5,713,805 | A * | 2/1998 | Scher et al. | 473/426 |
| 6,086,488 | A * | 7/2000 | Sanders | 473/423 |
| 6,099,419 | A | 8/2000 | Incaudo et al. | |
| 6,296,582 | B1 * | 10/2001 | Minniear | 473/428 |
| 6,514,161 | B1 * | 2/2003 | Minniear | 473/428 |
| 6,648,780 | B1 * | 11/2003 | Boldin | 473/461 |
| 2005/0113193 | A1 * | 5/2005 | Wardle et al. | 473/459 |

OTHER PUBLICATIONS

Web page printout, Fence Trainer, www.oncourtoffcourt.com/merchant2/merchant.mv?screen, 1 page, retrieved Nov. 18, 2003.

Web page printout, Horton Sports Pete Rose "Stroke Coach" Batting Trainer, www.buy.com/retail/product.asp?sku=200024016 &dcaid=15891, 1 page, retrieved Nov. 18, 2003.

Web page printout, Wilson Teaching Tree, www.wilson.com/wilson/products/product.jsp?PRODUCT%3C%3Eprd, 1 page, retrieved Sep. 22, 2003.

Web page printout, Wilson Teaching Tower, www.wilson.com/wilson/products/product.jsp?PRODUCT%3C%3Eprd, 1 page, retrieved Sep. 22, 2003.

Web page printout, Wilson Teaching Tether, www.wilson.com/wilson/products/product.jsp?PRODUCT%3C%Eprd, 1 page, retrieved Sep. 22, 2003.

* cited by examiner

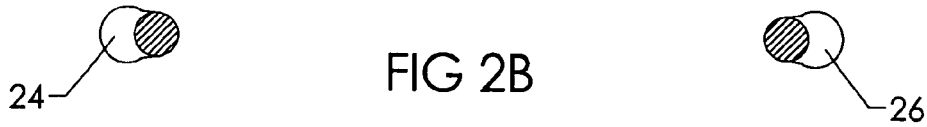
FIG 2B
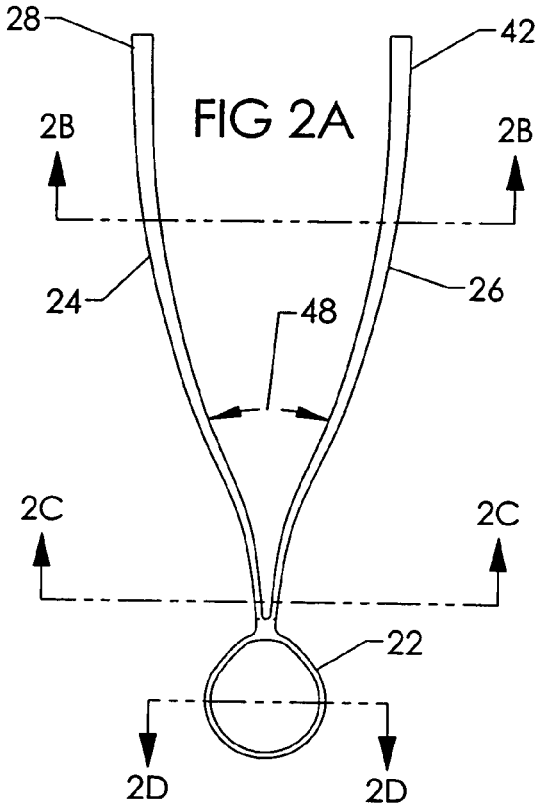
FIG 2A
FIG 2D
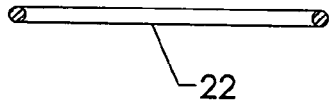
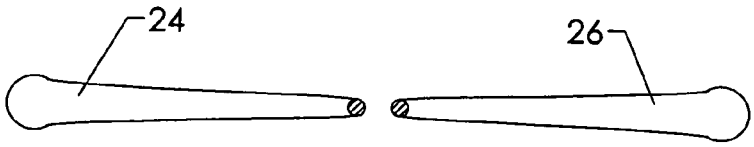
FIG 2C

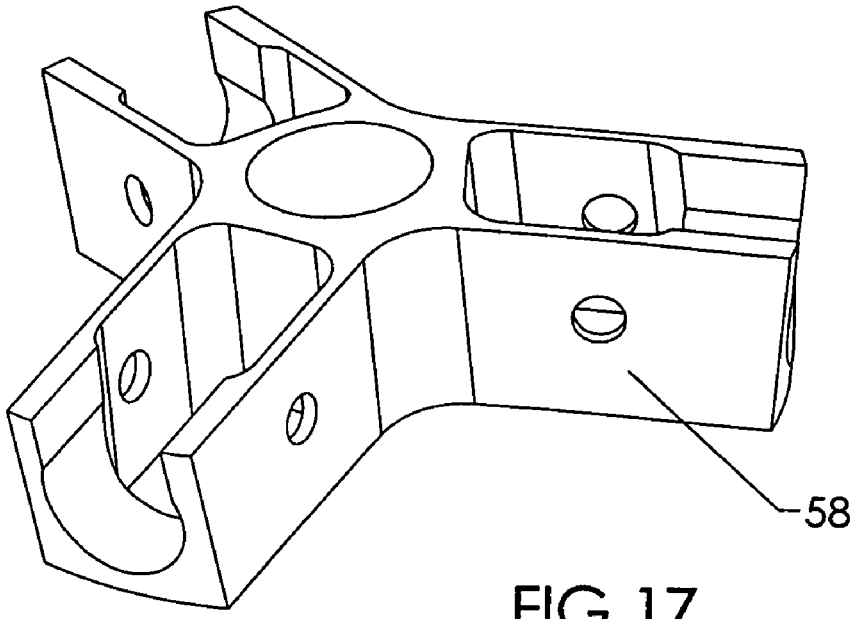
FIG 17
FIG 18
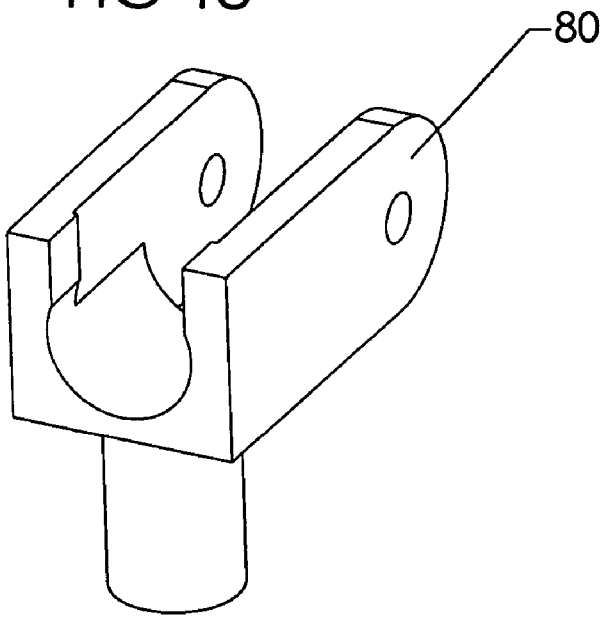
FIG 19
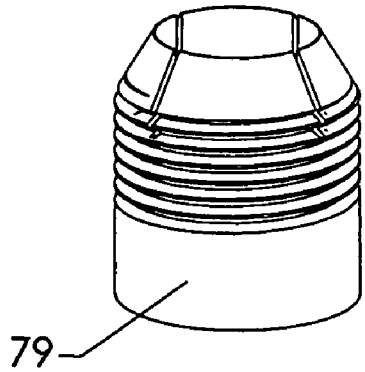

METHODS AND DEVICES FOR SPORT BALL TRAINING

CROSS REFERENCE TO RELATED APPLICATIONS

This application claims priority under 35 U.S.C. section 119(e) from U.S. Provisional Patent Application Ser. No. 60/489,959, titled "SPORT BALL TRAINING DEVICE AND METHOD", filed Jul. 23, 2003, by John L. Wardle and James M. Jensen and U.S. Provisional Patent Application Ser. No. 60/517,935, titled "SPORT BALL TRAINING DEVICE AND METHOD", filed Nov. 5, 2003, by John L. Wardle and James M. Jensen, both of which are also incorporated by reference herein in their entirety.

BACKGROUND

Many sports require the hitting of a ball using different techniques to gain a competitive advantage in a game. For example in the sport of tennis the technique of making the ball spin as it travels through the air provides some distinct advantages. One ground stoke technique is that of hitting a ball with top spin in which the ball can driven through the air at a high velocity and still remain in play due to the curved flight path that the ball takes. This technique requires a specific stoke pattern to be developed which is difficult to master when a balls are delivered by a ball machine or an assistant because the balls are in constant motion and they typically land in different positions with varying characteristics of bounce. When a mistake is made by a player or student attempting to learn a particular stroke technique, it can be difficult for the player to analyze and correct the problem due to the many inherent variables. Some of the existing devices for tennis training allow a player to practice repeated hits from a fixed location, however, these devices are often difficult to use or transport. In addition, for the existing training devices, the ball is typically fixed to some sort of tether or requires special modification of a ball in order to release from the device, which may have an adverse effect on the flight path and give the player a distorted perception of the success of their attempt to hit the ball. What has been needed are training techniques and devices to support the techniques that are simple and easy to implement, can accommodate any type of ball typically used in the game, including well worn practice balls, and that yield a natural and realistic flight path for a ball hit using the techniques and devices.

SUMMARY

In one embodiment, a sport ball training device includes a support device and a ball sling with at least one resilient sling member which has a first end secured to the support device. The resilient sling member is configured to elastically assume a predetermined configuration when in a relaxed state. A retainer member is secured to a second end of the resilient sling member and has a loop which is configured to releasably secure a sport ball.

In another embodiment, a sport ball training device includes a support device and a ball sling having a first resilient sling member with an upper end secured to the support device. The ball sling also has a second resilient sling member with an upper end secured to the support device. A retainer member is secured to lower ends of the resilient sling members and includes a loop configured to releasably hold a desired sport ball.

These and other advantages of embodiments will become more apparent from the following detailed description when taken in conjunction with the accompanying exemplary drawings.

BRIEF DESCRIPTION OF THE DRAWINGS

FIG. 2A is an elevational view of a ball sling of the sport ball training device of FIG. 1.

FIGS. 2B–2D are transverse cross sectional views of the ball sling of the sport ball training device of FIG. 2A taken along lines 2B—2B, 2C—2C and 2D—2D, respectively.

FIG. 17 is a perspective view of an embodiment of a support device base knuckle from the base of the device of FIG. 16.

FIG. 18 is a perspective view of an embodiment of a support device horizontal knuckle clamp from the upper end of the vertical tubular assembly of FIG. 16.

FIG. 19 is a perspective view of an embodiment of a split collet for the tubular riser assembly of the support device in FIG. 16.

DETAILED DESCRIPTION

Various embodiments of the invention are directed to methods and devices for assisting a player training in sports involving hitting a sport ball with a racquet, bat or other device. In one embodiment a device for the development of various tennis stokes is described where the device will not offer significant resistance to or deflection of the racket when the ball is struck, nor will the embodiment cause interference with the follow through of the racquet. Embodiments may be configured to hold a sport ball at a pre-determined height and allow the ball to travel freely and naturally when hit by a racquet without any detrimental initial restraining force exerted by the device on the ball at the time of impact. An embodiment includes a lightweight sport ball training device that can be folded quickly and easily into a compact size for transportation. Embodiments of the device include a resilient ball sling that will unwrap or uncoil itself from a transverse support arm after a ball disposed within a retainer member of the ball sling has been struck with a racquet, bat or similar device which also imparts motion to the sling. Embodiments of the ball sling which automatically uncoil or unwrap from a support arm or other supporting portion of the support device may include a resilient sling member or portion that has elastic, spring-like or superelastic properties. Embodiments of the ball sling can include a modular configuration that is designed such that the ball sling, or portions thereof, can be easily replaced when worn or damaged.

Figure 1:
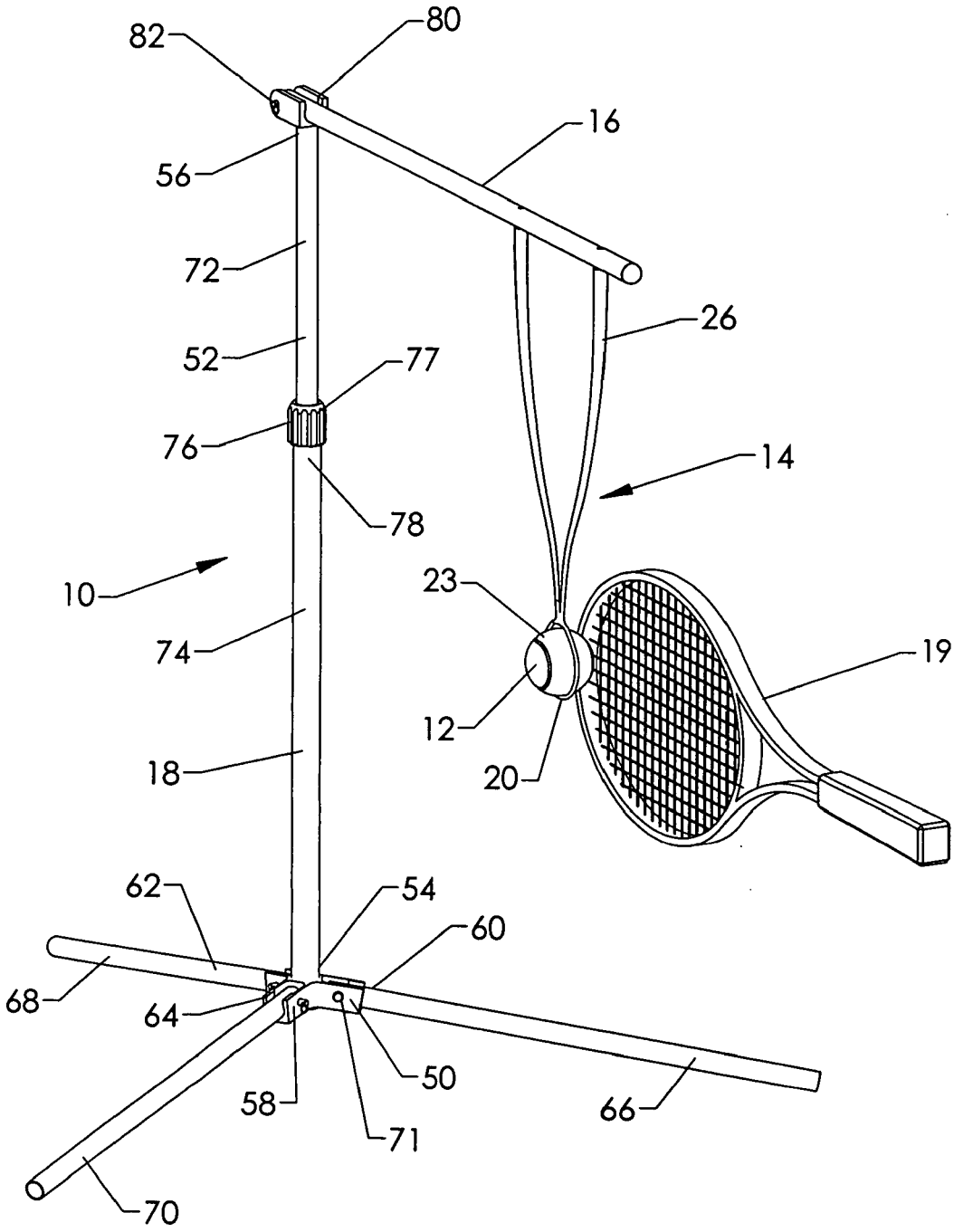
FIG. 1 is a perspective view of an embodiment of a sport ball training device.
Figure 2:
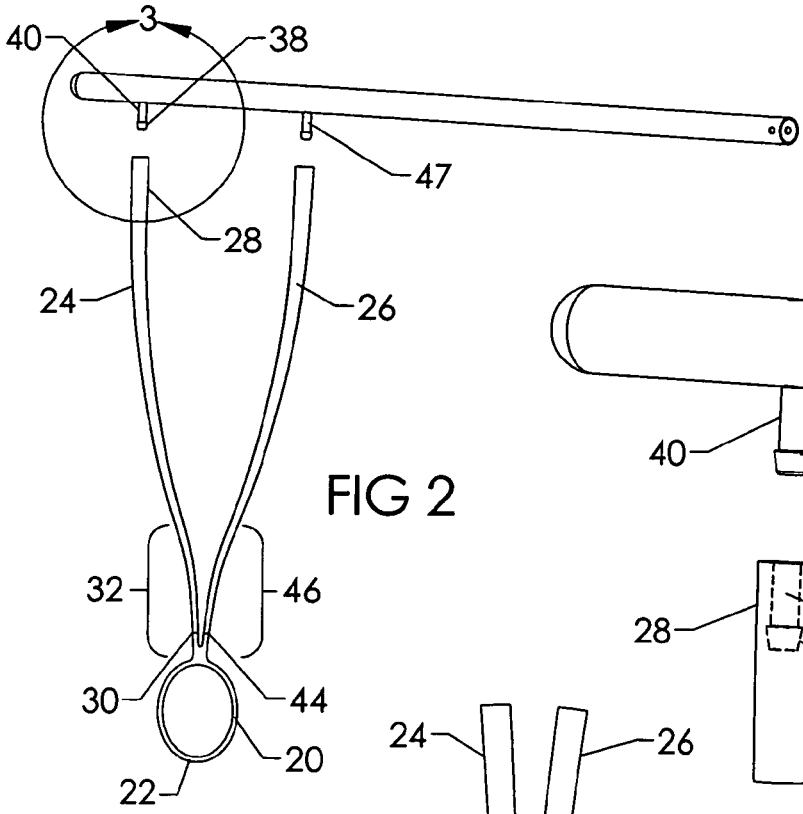
FIG. 2 is a detail view broken away of a transverse support arm of the sport ball training device of FIG. 1.

An embodiment of a sport ball training device 10 configured for use with a tennis ball 12 includes a ball sling 14 that hangs from a transverse support arm 16 of a support device 18 as shown in FIG. 1. The ball sling 14 is used to hold the ball 12 stationary at a pre-determined height for contact with an instrument such as racquet 19. The ball sling 14 is configured with a retainer member 20 that includes a loop 22 that is used to hold the tennis ball 12 in a stationary position and is more clearly shown in FIG. 2.

The embodiment of the loop 22 shown in FIGS. 1–4 may be constructed from of an elastic or elastomeric material and has an inner circumference that may be chosen as a particular function of the nominal outer diameter of the ball it is intended to restrain, depending of the qualities of the specific ball. For example, the inner circumference of the loop 22 may be the same as or slightly larger than the outer circumference of a light weight textured ball, such as a tennis ball. The texturing or "fuzziness" of a tennis ball may facilitate retention within the loop 22 and allow a loose fit. On the other hand, heavy smooth surfaced balls, such as baseballs, may require a loop 22 that has a nominal inner circumference that is slightly smaller than the outer circumference of the ball, that the loop 22 is configured to hold. Embodiments of the loop 22 may restrain the ball by surface friction between the ball 12 and the loop 22, compressive force between the ball 12 and the loop 22 or both. Compressive force is generally applied to an outer surface 23 of the ball 12 along a plane that intersects or nearly intersects the center of the ball 12. With regard to embodiments using heavy smooth surfaced balls, such as baseballs, the retainer member 20 can restrain the ball 12 by compressive force. Balls that have surface texture e.g. tennis balls having a fuzzy or fibrous type outer surface may only require close contact between the outer surface 23 of the ball 12 and the loop 22 to be restrained as the fibrous surface grips the sling by surface friction with sufficient force to maintain the position of the ball 12 in the loop 22.

In one embodiment, the loop 22 is made from an elastic material that is sufficiently resilient for the loop to maintain a substantially round open configuration in a relaxed state to facilitate placement of a sport ball within the loop. Embodiments of the loop 22 may have an inner circumference of about 5 percent smaller to about 5 percent larger than an outer circumference of a sport ball 12 for use with the training device. In another embodiment, an inner circumference of the loop 22 is about 3 percent to about 7 percent smaller than an outer circumference of a sport ball 12 for use with the training device. In another embodiment, an inner circumference of the loop 22 is about 3 percent to about 7 percent larger than an outer circumference of a sport ball 12 for use with the training device. In yet another embodiment, the loop 22 has an inner circumference of about 8.0 inches to about 9.0 inches. An embodiment of the elongate looped element 21 of the loop 22 that forms the loop 22 can have an outer transverse dimension or diameter of about 0.12 inches to about 0.16 inches.

Figure 3:
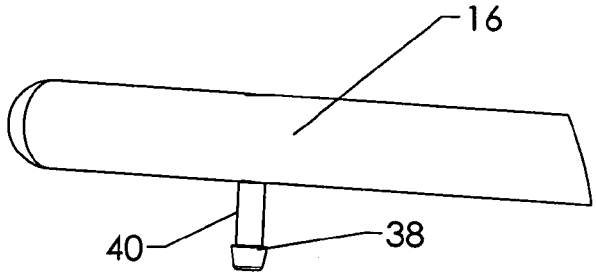
FIG. 3 is an enlarged view of a connection between an upper end of a resilient sling member and the transverse support arm of the sport ball training device of FIG. 1 indicated by the encircled portion 3 of FIG. 2.
Figure 4:
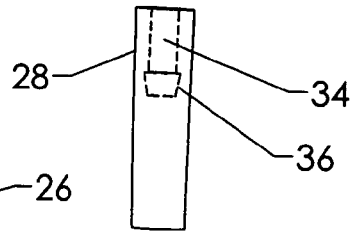
FIG. 4 is an enlarged view broken away of the retainer member of FIG. 2 including a loop configured to releasably secure a sport ball which is shown disposed within the loop.
Figure 4:
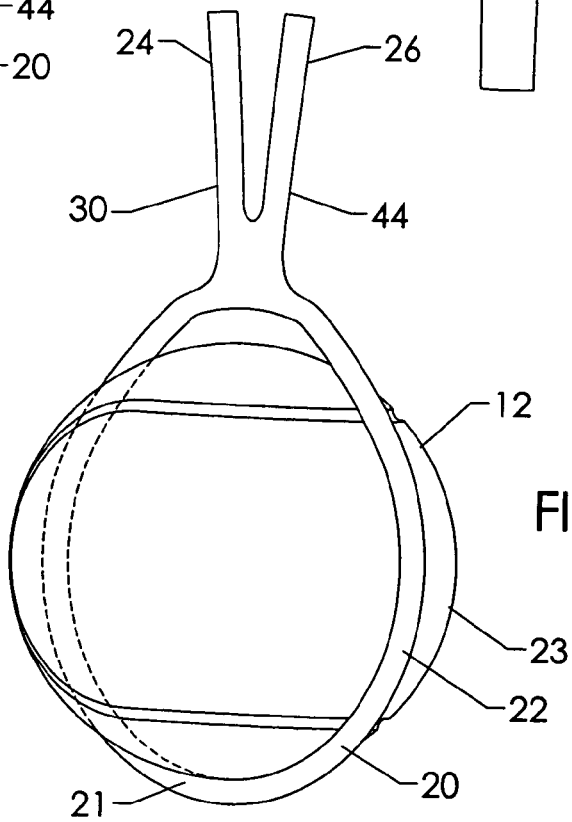

The ball sling 14 also includes a first sling member 24 and a second sling member 26. The first sling member 24 has an upper end 28, a lower end 30 and a shock absorbing zone 32. The upper end 28 has a cavity 34 with a recessed portion 36 configured to elastically capture an enlarged portion 38 of a barb 40 that is secured to and extends downward from the transverse support arm 16 of the support device 18 as shown in FIG. 3. This configuration allows the upper end 28 of the first sling member 24 to be easily installed and removed from the transverse support arm 16 for transport or replacement. The second sling member 26 may have the same or similar features, dimensions and materials as those of the first resilient sling member 24. The second sling member 26 has an upper end 42, a lower end 44 and a shock absorbing zone 46. The upper end 42 of the second resilient sling member 26 may be secured to the transverse support member 16 in the same fashion as the first resilient sling member 24. Another barb 47 is provided on the transverse support arm 16 for the upper end 42 of the second sling member 26.

The upper ends 28 and 42 of the first and second resilient sling members 24 and 26 may be separated by a greater distance than the distance between the lower ends 30 and 44, which may be joined together in some embodiment, such as the embodiment of FIGS. 1–4. As such, the resilient sling members 24 and 26 form an angle indicated by arrow 48 between them. The angle indicated by arrow 48 may be from about 10 degrees to about 60 degrees for some embodiments, more specifically, about 15 degrees to about 25 degrees. This triangular arrangement between the transverse support arm and the retainer member 20 give the ball sling 14 a stable configuration that minimizes the amount of undesired side to side movement of the ball 12 while disposed within the ball sling 14. In addition, this arrangement helps to minimize rotation of the ball sling 14 and maintain the ball sling 14 in a single plane while in the resting position with the exposed surface of the ball facing rearward for impact by a racquet or the like without hitting the loop 22.

The sling members 24 and 26 have a tapered configuration wherein the outer transverse dimension or diameter of the sling members 24 and 26 tapers to an decreased dimension from the upper ends 28 and 42 to the lower ends 30 and 44. For embodiments of the sling members made from a uniform material, such as an elastic polymer, this creates an increase in resistance to bending from the lower ends 30 and 44 to the upper ends 28 and 42 for each of the resilient sling members 24 and 26. This configuration provides a resilient propensity to recoil and assume the substantially straight configuration of the resting position of the resilient members 24 and 26 after being struck by a racquet or the like. In one embodiment, the resilient sling members 24 and 26 may have an inclusive taper angle of about 0.5 degrees to about 5 degrees, more specifically, about 0.5 degrees to about 1.0 degrees. In another embodiment, the resilient sling members 24 and 26 may have an inclusive taper angle of about 0.5 degrees to about 1.5 degrees. Embodiments of the sling members 24 and 26 may have a length of about 12 inches to about 25 inches for some embodiments.

The entire ball sling 14 may be made from a monolithic structure of elastic or elastomeric material capable of absorbing shock during impact of a racquet on the ball 12. However, the majority of shock absorption after impact on the ball 12 occurs in the shock absorbing zones 32 and 46 located on the sling members 24 and 26 adjacent the retainer member 20 and in the loop 22 of the retainer member 20. For the configuration of the embodiments of sling members 24 and 26 the majority of the shock absorption within the sling members 24 and 26 occurs within the zones 32 and 46 because of the tapered configuration of the sling members 24 and 26 produces a smaller transverse dimension or diameter in the lower portions of the sling members 24 and 26 which thereby results in lower resistance to stretching in the zones 32 and 46. The loop 22 of the retainer member 20 absorbs a high percentage of shock on impact for the same reason, specifically, the transverse cross section and corresponding resistance to stretching of the loop 22 is similar to that of the shock absorbing zones 32 and 46. In other embodiments discussed below, alternate structures for the purpose of shock absorption zones adjacent the retainer member 20 are discussed.

Embodiments of the loop 22 of the retainer member 20, as well as the ball sling 14 generally, may be made from any suitable elastic, resilient material. It may also be useful for the material of the ball sling 14 including the loop 22 to be resistant to breakage and fatigue as repeated impact from a racquet or bat can be destructive. Materials such as silicones, polyurethanes, rubbers, mixtures or alloys of these, or the like may be used. In some embodiments, elastomers, such as thermoplastic elastomers, having durometers of 25 A shore to about 65 A shore may be used. Specific materials, such as Kraton® materials Dynaflex® G2711 and Dynaflex® G2706, manufactured by GLS Corporation, in McHenry Ill., may be useful individually or in combination. Mixtures such as 50% Dynaflex G2706 and 50% Dynaflex G2711 and other mixtures such as 66% Dynaflex G2711 and 34% Dynaflex G2706 may be useful for construction of the ball sling 14 in general. The embodiment of the ball sling 14 shown in FIGS. 1–4 may be a monolithic structure injection molded at one time from a substantially uniform material, such as the polymers discussed above. Such a method of manufacture reduces cost and manufacturing time and for some materials produces a strong and resilient ball sling 14. A modification of the monolithic structure could also include methods of over molding one material over another to achieve the desired properties of multiple materials.

Figure 15:
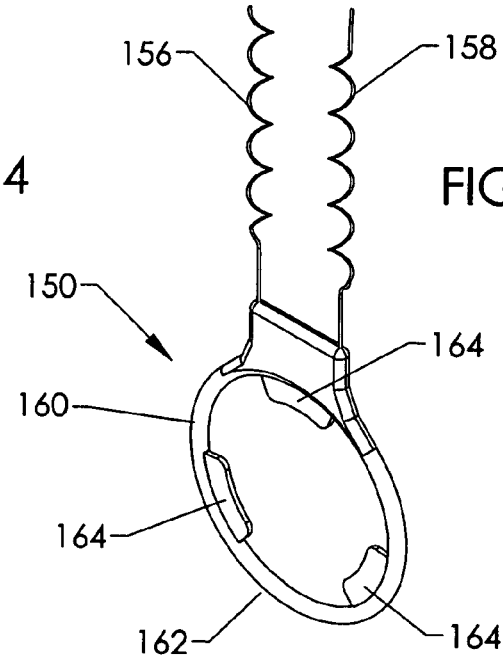
FIG. 15 is an enlarged view of the ball restraining sling as indicated by the encircled portion 15 of FIG. 14.
Figure 16:
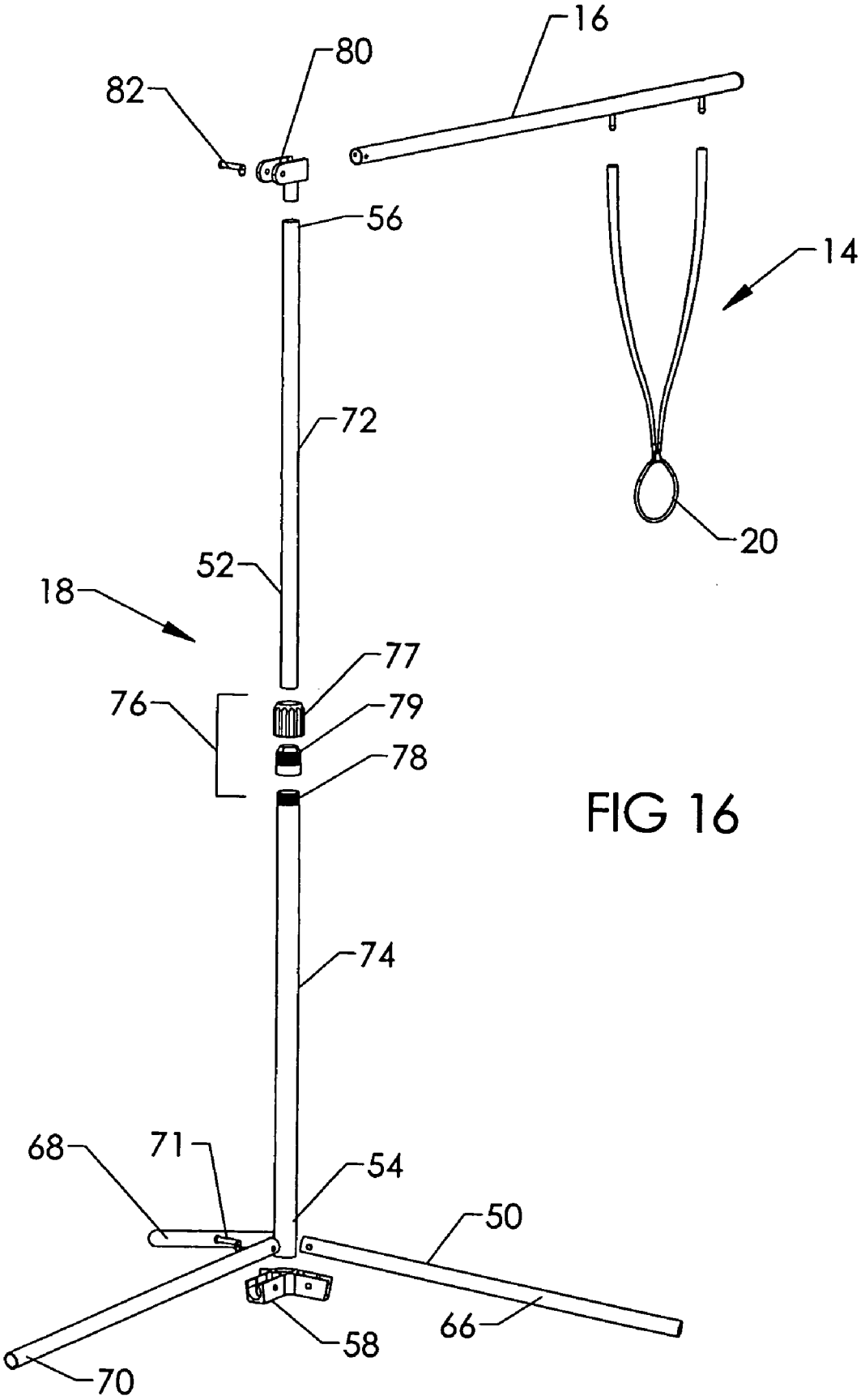
FIG. 16 is an exploded perspective view of the sport ball training device of FIG. 1 showing various components of the embodiment.

For the embodiment of FIGS. 1–4, loading a ball 12 into the loop 22 of the retainer member 20 is achieved by simply stretching the loop 22 onto the centerline of the ball 12. The loop 22 is configured such that the restraining force is enough to stop the ball 12 from falling out of the loop 22 on its own or by force of the ball's own weight, but not enough to restrain the ball 12 if it is lightly struck by a racquet, club, player's hand or other such device. Although the embodiment of the ball restraining device 10 shown in FIG. 1 includes a loop 22 to restrain the ball 12, other configurations are also contemplated. For example, a resilient fork or prong that encompasses a portion of a ball's outer surface and releasably restrains the ball may be used as a retention member 20 on the ball sling 14. Also, a retention member 20 may use a loop with circumferentially spaced contacts points or ribs as is shown in FIG. 15.

Referring to FIG. 1, the support device 18 includes a base 50, a riser tube assembly 52 having a lower end 54 secured to the base 50, and the transverse support arm 16 secured to and extending radially from an upper end 56 of the riser assembly. In the embodiment of FIG. 1, the transverse support arm 16 is substantially perpendicular to the riser tube assembly 52 in a horizontal position, but could also be set at another angle with respect to the riser tube assembly 52. The base 50 includes a knuckle 58 pivotally secured to first ends 60, 62 and 64 of three legs 66, 68 and 70, respectively, by clevis pins 71. The legs 66, 68 and 70 extend radially and somewhat downward from the knuckle 58 when in a deployed state to form a stable three point contact base. The riser tube assembly may have at least two tubular members 72 and 74 with the first tubular member 72 configured to slide within the second tubular member 74 in a telescoping arrangement. A locking member 76 in the form of a split collet assembly with a threaded rotating locking ring 77 is disposed on an upper end 78 of the second tubular member 74 to prevent relative axial movement between the two tubular members 72 and 74 when in a locked position. The transverse support arm 16 is connected to a horizontal clamp or knuckle 80 with a clevis pin 82. Horizontal clamp 80 in turn is permanently attached to the upper end 56 of the first vertical support tube 72.

Figure 5:
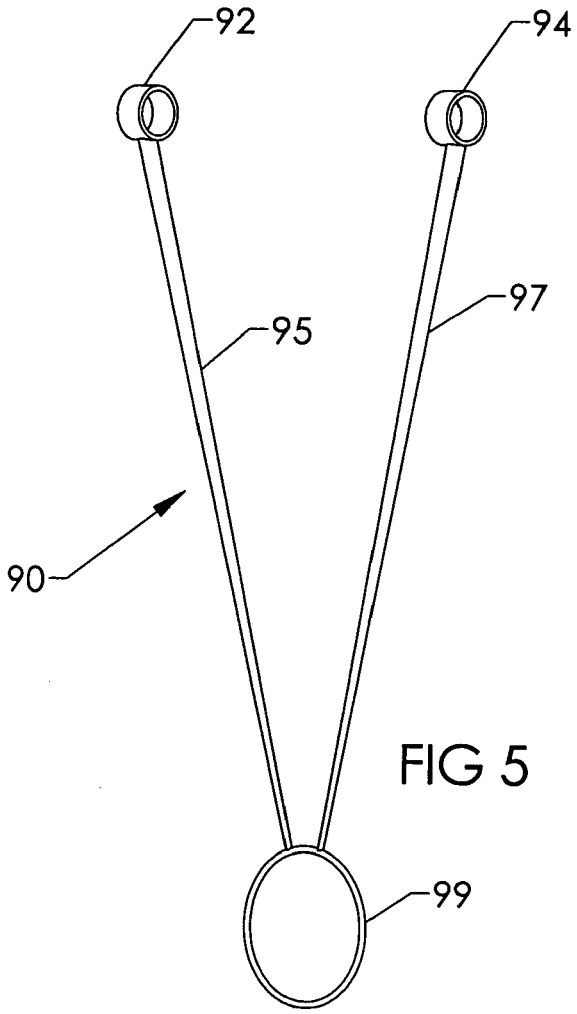
FIG. 5 is a perspective view of an embodiment of a ball sling having two resilient sling members secured between support device connectors in the form of rings at the upper ends of the sling members and a retainer member in the form of a resilient loop at the lower ends of the sling members.
Figure 6:
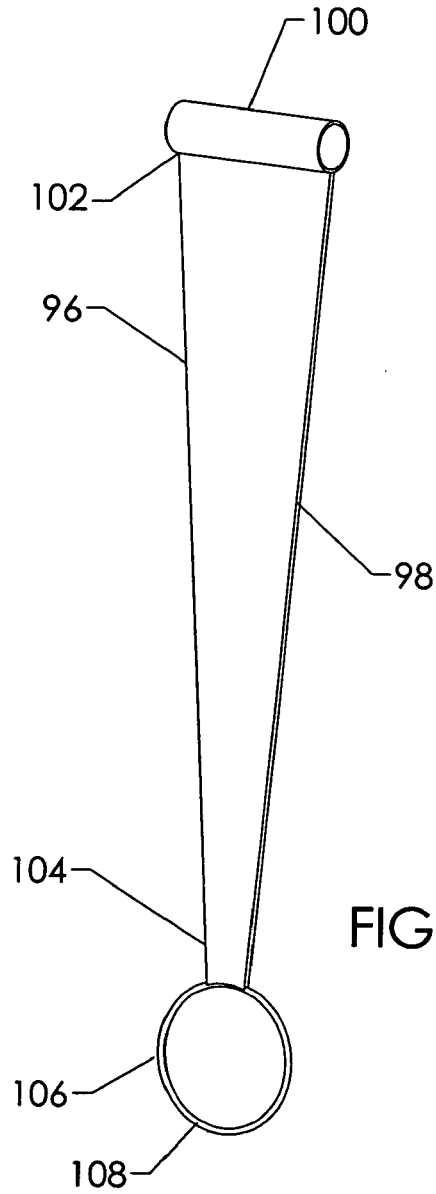
FIG. 6 is a perspective view of another embodiment of the ball sling having a single resilient sling member secured to a support device connector at the upper end of the sling member and a retainer member in the form of a resilient loop secured to a lower end of the sling member.
Figure 7:
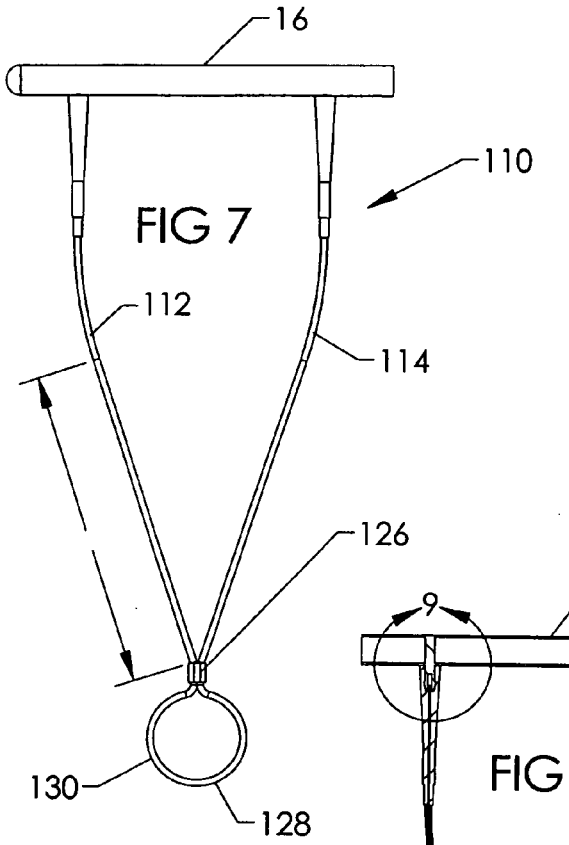
FIG. 7 is a front view of another embodiment of a ball sling.
Figure 7A:
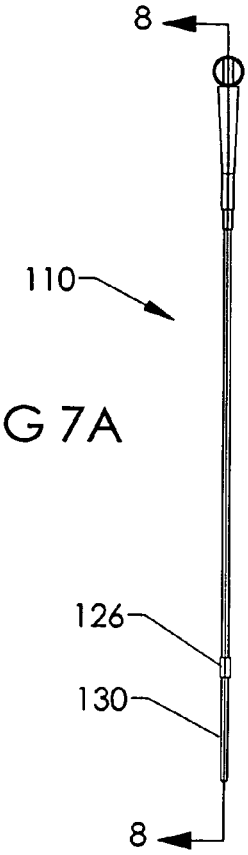
FIG. 7A is a side view of the ball sling of FIG. 7.
Figure 8:
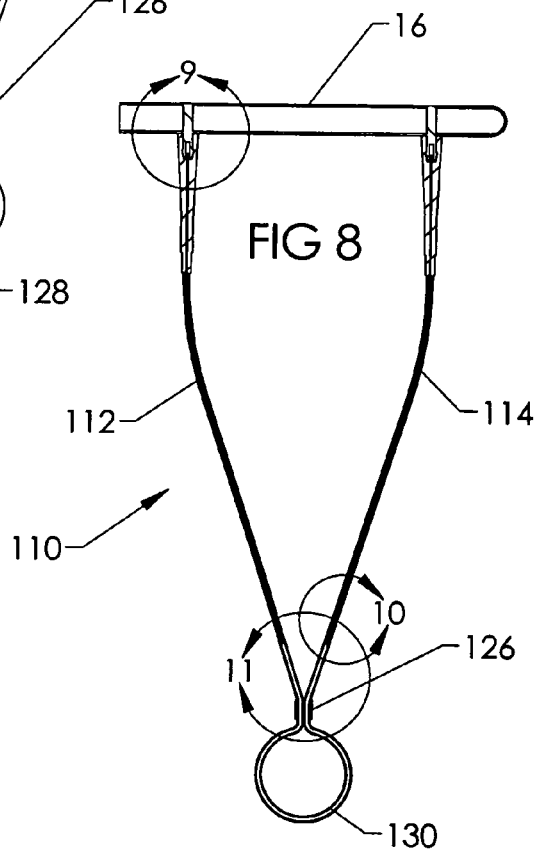
FIG. 8 is a view in partial section of the ball sling of FIG. 7.
Figure 9:
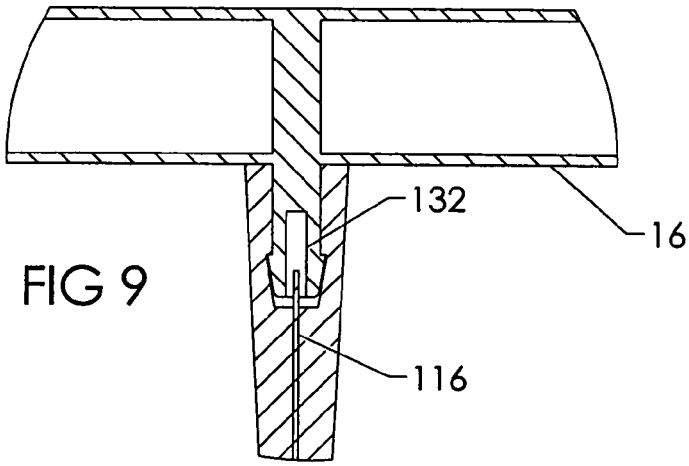
FIG. 9 is an enlarged view in partial section of the ball sling as indicated by the encircled portion 9 of FIG. 8.
Figure 11:
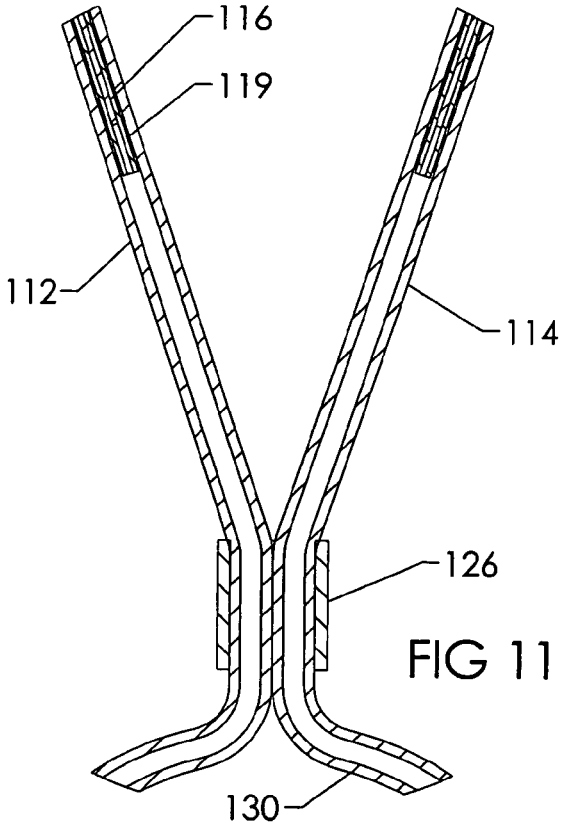
FIG. 11 is an enlarged view in partial section of the ball sling as indicated by the encircled portion 11 of FIG. 8.
Figure 10:
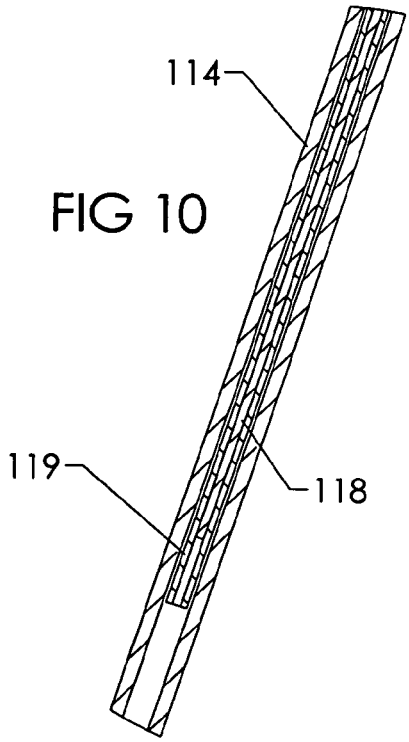
FIG. 10 is an enlarged view in partial section of a sling member as indicated by the encircled portion 10 of FIG. 8.

FIGS. 5 and 6 show ball sling embodiments constructed from a single or uniform material. One method of manufacture for these and other ball sling embodiments would be injection molding of any of the materials discussed above with respect to the ball sling embodiment 14 of FIG. 1. The sling members may transition in transverse cross section from a first cross sectional area at the loop to a second greater transverse cross sectional area at the upper end of the sling member adjacent the support device. Such a transition in cross section of the sling members can provide ball sling recoil means to unwind the ball sling that wraps itself around the transverse support arm 16 after a ball has been hit. The ball sling embodiment 90 shown in FIG. 5 has an alternate method of attachment to the transverse support arm 16. Ball sling 90 has a pair of retention loops 92 and 94 secured to upper ends of sling members 95 and 97 which have a nominal inside diameter that is smaller than an outside diameter of the transverse support arm 16. The retention loops 92 and 94 are stretched in order to place them over the transverse support arm 16 and are held in place by friction. This allows for easy replacement of the ball sling 90 if worn or damaged. The lower ends of the sling members 95 and 97 are secured to loop 99. Other suitable means for providing easy replacement or modularity of the sling 90 can be used. Alternatively the ball sling 90 can be permanently attached to the transverse support arm 16.

FIG. 6 shows a ball sling embodiment where the ball sling 96 is constructed with a single sling member 98 that is in the form of a thin sheet of elastomeric material with a single retention loop 100 at the upper end 102 for attachment to a transverse support arm 16. A lower end 104 of the sling member 98 is secured to a retainer member 106 having a loop 108 similar to the loop 22 of the ball sling 14 discussed above. The sling member 98 has a substantially constant thickness, but varies in width from a starting width at the lower end 104 adjacent the loop 108, and increasing to a greater width at the upper end 102 adjacent the retention loop 100. This configuration produces a sling member 98 having an increased resistance to longitudinal bending from the lower end 104 to the upper end 102 which facilitates recoil or unwinding of the ball sling 96 from a support member 16 after impact and subsequent winding about the support member 16.

FIGS. 7 through 11 show a ball sling 110 that is made from tubular elastomeric sling members 112 and 114 with free-floating resilient recoil wires 116 and 118 disposed within the sling members 112 and 114. The recoil wires 116 and 118 may be made from a resilient spring material such as music wire, superelastic materials such as nickel titanium wire, fiberglass elements, or the like. The recoil wires 116 and 118 are secured to an upper portion of the resilient sling members 112 and 114 but free floating through an inner lumen of the lower portion of the sling members. This configuration leaves the lower ends of the sling members 112 and 114 unrestrained axially and free to stretch and absorb shock during impact. The recoil wires 116 and 118 also have an outer protective lubricious sheath 119 of resilient tubing such as Teflon® (PTFE), kynar or polyolefin placed over it which extends beyond the lower ends of the recoil wires 116 and 118 to serve as a strain relief.

The strain relief protects the tubular elastomeric material of the sling members 112 and 114 and prevents the metal wire from puncturing through the sling member tube when the ball sling 110 is tightly flexed. This embodiment 110 also has a sleeve 126, which is disposed tightly over the sling members 112 and 114 adjacent the retainer member 128. Sleeve 126 can be bonded in place or left unattached so the user can adjust the circumference of the loop 130 of the retainer member 128. The sleeve's 126 position is adjusted by stretching the ball sling 110, which reduces the diameter of the components and allows the sleeve 126 to be repositioned. In other embodiments, the ball sling 110 may be made from an elongate elastomeric member having a reinforcement layer, such as a braid, disposed over the elastomeric tubing. The upper ends of the sling members 112 and 114 may be secured to the support 16 by a barb 132 in a fashion similar to that discussed above and shown in FIG. 9.

Figure 12:
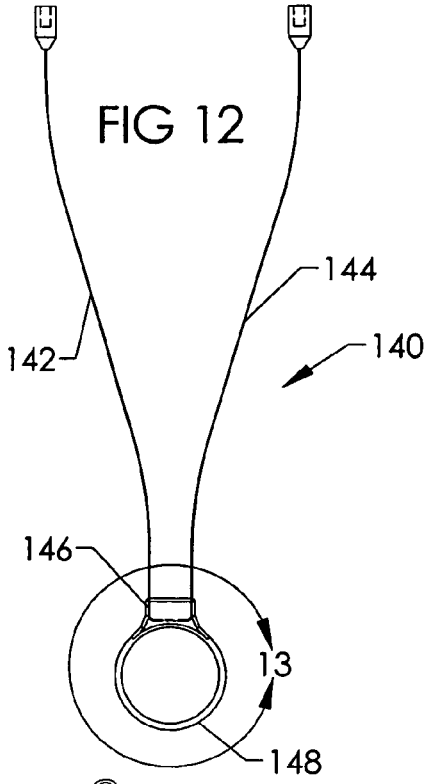
FIG. 12 illustrates another embodiment of a ball sling.
Figure 13:
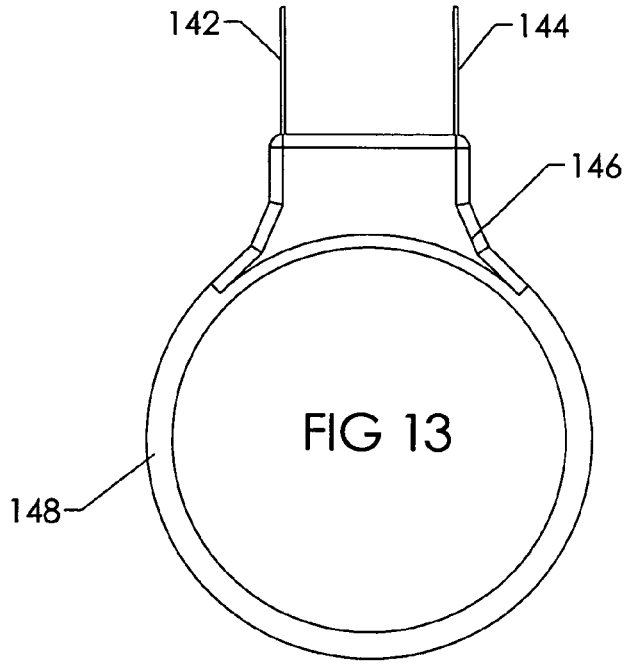
FIG. 13 is an enlarged view of the ball sling as indicated by the encircled portion 13 of FIG. 12.

FIGS. 12 & 13 show another ball sling embodiment 140 that has sling members 142 and 144 constructed from metal spring wire. The lower portion or loop 146 of the sling members 142 and 144 are insert molded into an elastomeric loop 148 as shown by the dashed portion of the member in FIGS. 12 and 13. The spring metal sling members 142 and 144 of this embodiment are not coated or surrounded by any polymer or elastomeric material which provides a simple design that is suited mainly for low velocity impacts as it has no shock absorbing features other than the loop portion 148. The metal spring sling members 142 and 144 may be made of any suitable metal, including spring steel and superelastic alloys, such as nickel titanium alloys.

Figure 14:
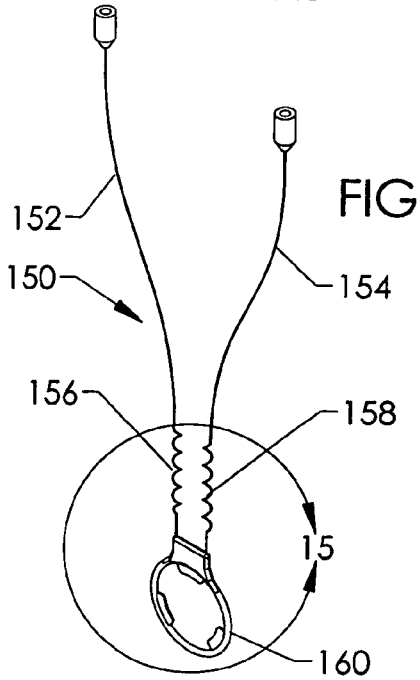
FIG. 14 illustrates another embodiment of a ball sling.

FIGS. 14 and 15 show another ball sling embodiment 150. The spring metal sling members 152 and 154 of this embodiment are not coated or surrounded by any polymer or elastomeric material but shock absorbing sections 156 and 158 are incorporated in the sling members 152 and 154 in the form of a helical wind which reacts like an extension spring when exposed to tensile load. Striking balls at a high velocity may put high levels of stress on the ball sling 150. These embodiments, as well as others, may employ shock absorbing features to overcome this problem. This embodiment also has a rigid retainer member 160 with a loop 162 made from high impact plastic e.g. polycarbonate nylon molded over the spring metal sling members 152 and 154. Two or more inward radial protrusions 164 are attached to the rigid retainer member and are sized to make contact with and restrain a sport ball.

FIGS. 16–19 illustrate the support device 18 of the sport ball training device 10 in an exploded view illustrating the cooperation of the various components of the embodiment. The support device 18 includes a base 50, a riser tube assembly 52 having a lower end 54 secured to the base 50, and the transverse support arm 16 secured to and extending radially from an upper end 56 of the riser assembly. The base 50 includes a knuckle 58 pivotally secured to first ends 60, 62 and 64 of three legs 66, 68 and 70, respectively, by clevis pins 71. The legs 66, 68 and 70 extend radially and somewhat downward from the knuckle 58 when in a deployed state to form a stable three point contact base. The riser tube assembly may have at least two tubular members 72 and 74 with the first tubular member 72 configured to slide within the second tubular member 74 in a telescoping arrangement. A locking member 76 includes a split collet 79 with a threaded rotating locking ring 77 threaded onto a threaded upper end 78 of the second tubular member 74.

The threaded lock ring 77 threads onto a threaded portion 78 of the upper end of the lower tubular member 74 with the split collet 79 disposed within the threaded cap and the upper tubular member 72 slidingly disposed within the split collet 79, the threaded locking ring 77 and the lower tubular member 74. Tightening of the threaded locking ring 77 forces the split collet 79 closed which then applies a restrictive compressive force on the upper tubular member 72 and fixes the upper tubular member 72 in relation to the lower tubular member 74. The locked arrangement is reversed by unscrewing the threaded locking ring 77 so that the split collet 79 can return to its resting configuration which again allows the upper tubular member 72 to slide within it. The transverse support arm 16 is connected to a horizontal clamp or knuckle 80 with a clevis pin 82. Horizontal clamp 80 in turn is permanently attached to the upper end 56 of the first vertical support tube 72.

Figure 20:
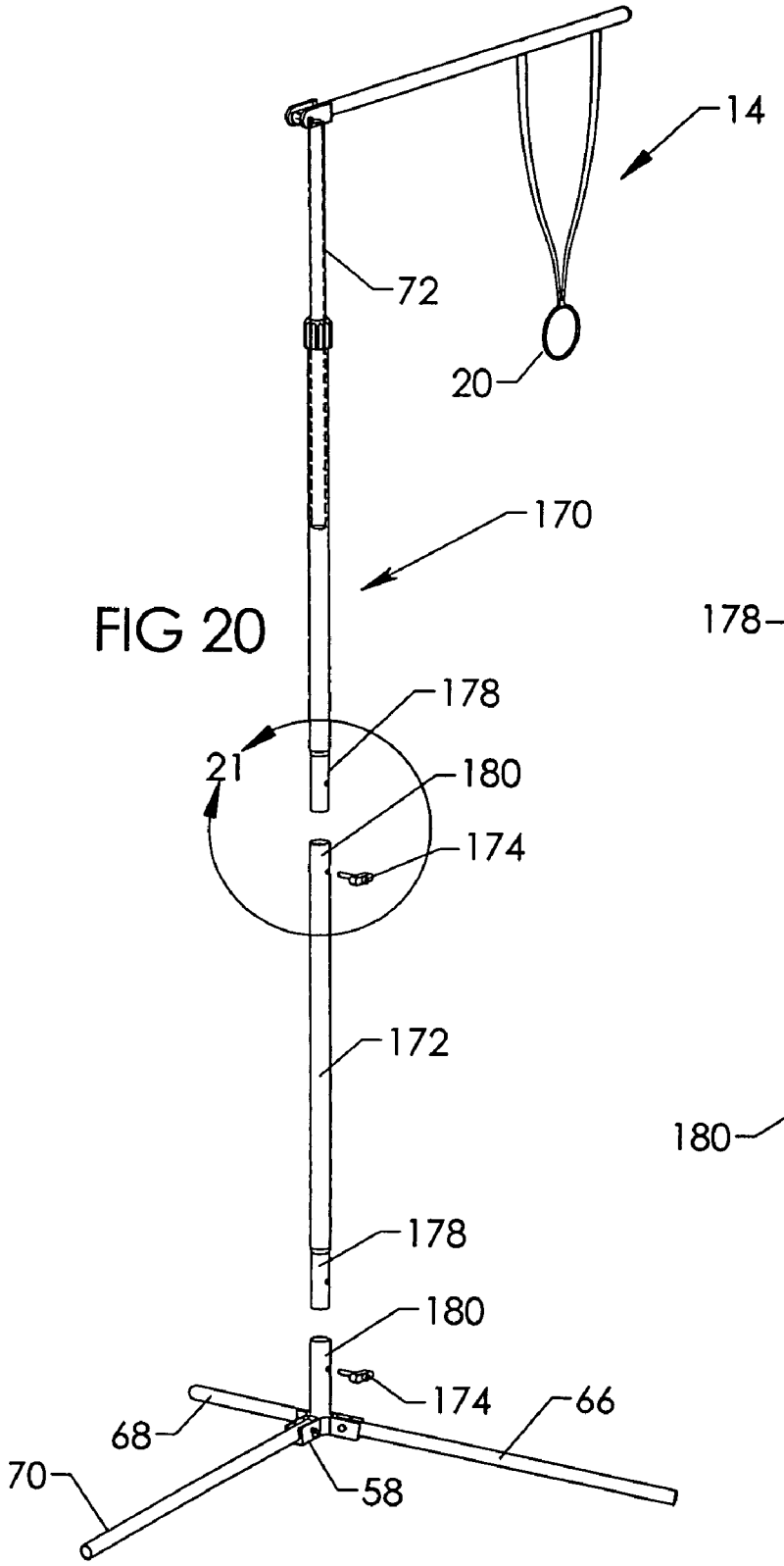
FIG. 20 is a perspective view of an embodiment of a sport ball training device illustrating an optional extension arrangement for the tubular riser assembly of the sport ball training device of FIG. 16.
Figure 21:
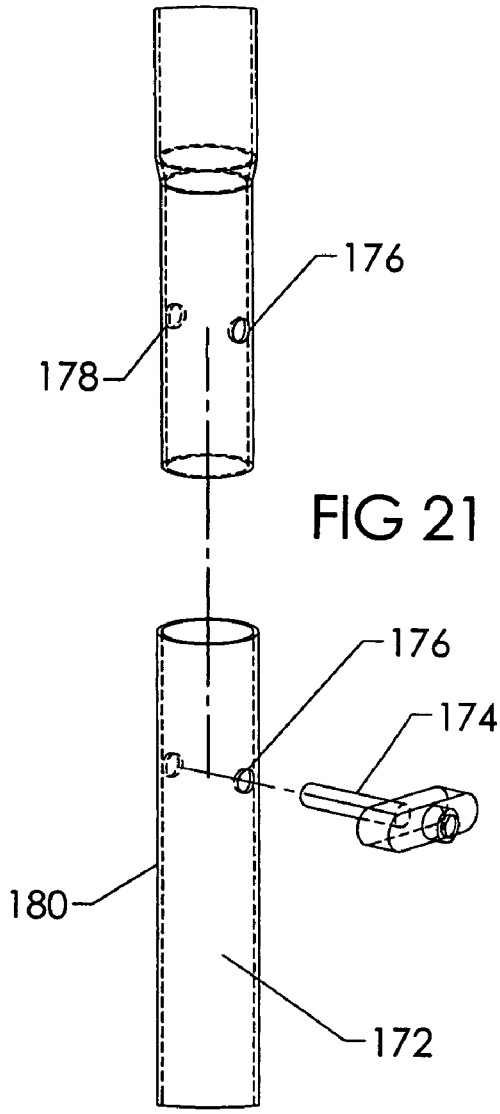
FIG. 21 is an enlarged view of the tubular riser assembly of the sport ball training device of FIG. 20 indicated by the encircled portion 21 in FIG. 20.

FIGS. 20 and 21 illustrate another embodiment of the support device 170 which includes extension members 172 in order to achieve a desired amount of vertical adjustment.

FIGS. 20 and 21 show an embodiment of a support device 170 wherein the adjustable height can be increased by adding extension tubes 172 which dock together in a telescoping arrangement and are locked together by placing a retaining pin 174 or the like through the respective retainer pin holes 176 when they are aligned. The extension tubes 172 may have a male end 178 having a reduced outer diameter or transverse dimension which is configured to fit within a mating female end 180 having an inner transverse dimension or diameter that accepts the male end as shown in FIG. 21. With this configuration, multiple extension tubes may be used in series.

The extension tubes 170 may be made to increase the height by increments of the working range of vertical adjustment of the tubular elements 72 and 74 of the riser tube assembly 52 shown in FIG. 1. The working range of the riser tube assembly 52 may be from about 15 inches to about 25 inches for some embodiments. Multiple extension tubes 172 can also be stacked onto one another in series to achieve any desired height which may be useful for some applications of the sport ball training device 10. For example, an embodiment of a sport ball training device 10 that has a working height range for the ball 12 above the ground of about 20 inches to about 40 inches from the ground, may be useful for training in certain types of ground strokes in the game of tennis. The addition of one extension tube 172 of about 20 inches in length will increase the working height range to about 40 inches to about 60 inches. The addition of two extension tubes 172 in series will yield a working height range of about 60 inches to about 80 inches. The additional working height range may make the sport ball training device suitable for use with the training of volley shots and service techniques in the sport of tennis.

Figure 22:
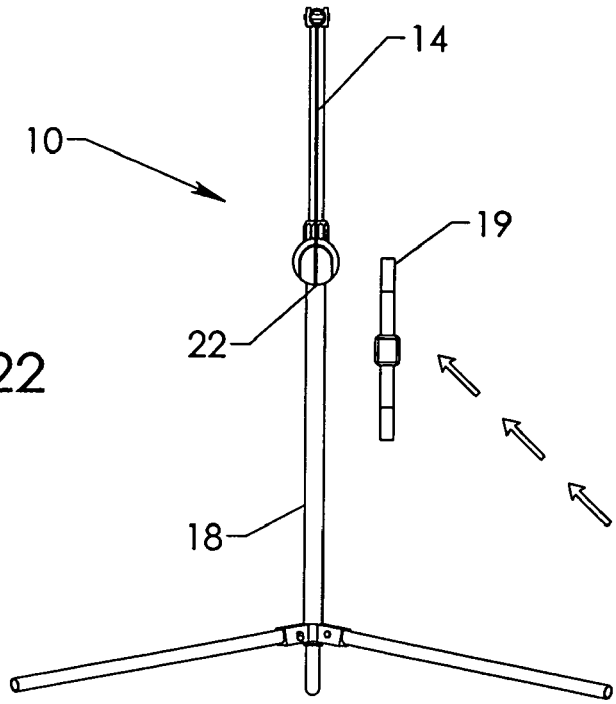
FIG. 22 is a side view of the sport ball training device of FIG. 1 set up for hitting a ball with topspin with a sport ball disposed within the loop of the ball sling.
Figure 23:
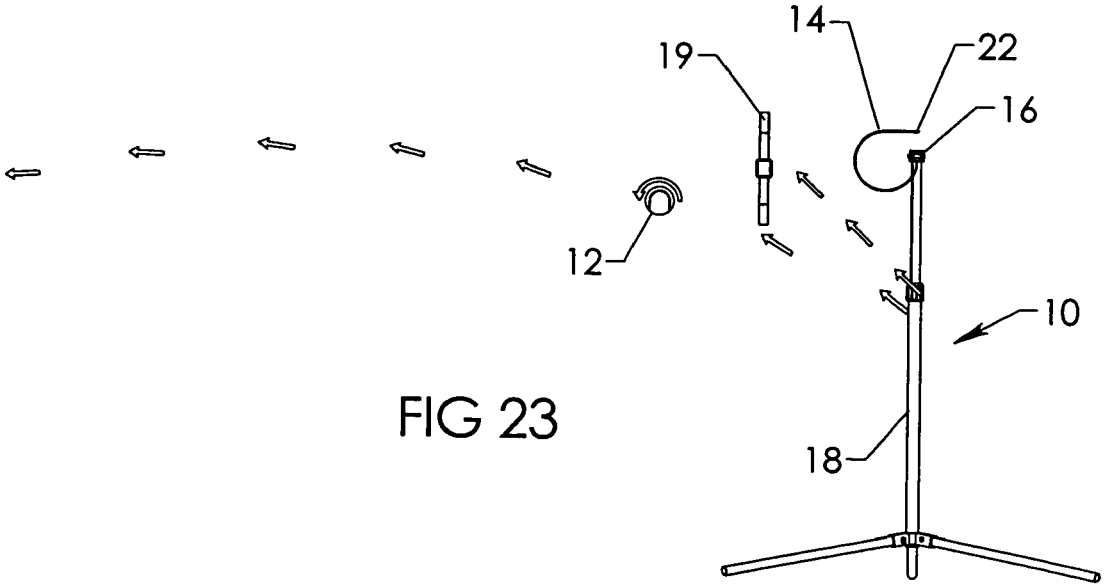
FIG. 23 is a side view of the sport ball training device of FIG. 22 after the ball has been hit with a topspin inducing stroke of the racquet.

FIG. 22 shows an embodiment of the sport ball training device 10 of FIGS. 1–4 and method of hitting a ball with topspin. Creating top spin requires that the user swing a racket from a low to high position as indicated by direction arrows, simultaneously the racket face must achieve a perpendicular alignment to the ground below the ball. FIG. 23 shows the resulting reaction of the ball sling 14 and ball 12 upon impact with a racquet. When the ball is stuck the ball sling 14 begins to follow the flight path of the ball 12 to which it is releasably secured but is forced to rotate about the axis of the transverse support arm 16. This causes the loop 22 of the retainer member 20 to stretch and the ball 12 then disengages the loop 22. The wrapping of the ball sling 14 about the transverse support arm 16 after release of the ball 12 moves the ball sling 14 out of the path of the racquet in order for the s ling to have no significant impact on the practice stoke. The wrapping motion of the ball sling 14 also stores energy in the ball sling 14 during the process that will eventually serve to unwind the ball sling 14 from the support arm 16. After the completion of the racquet stroke, the spin and flight path of the ball 12 can be observed thereafter by the user. When the device is used on a tennis court the user can readily observe the result of the technique used and make the necessary corrections to the user's stroke. The device also facilitates the coaching process whereby a coach can stand close to the stroke action of the user and observe and correct the technique based on the observations.

Figure 24:
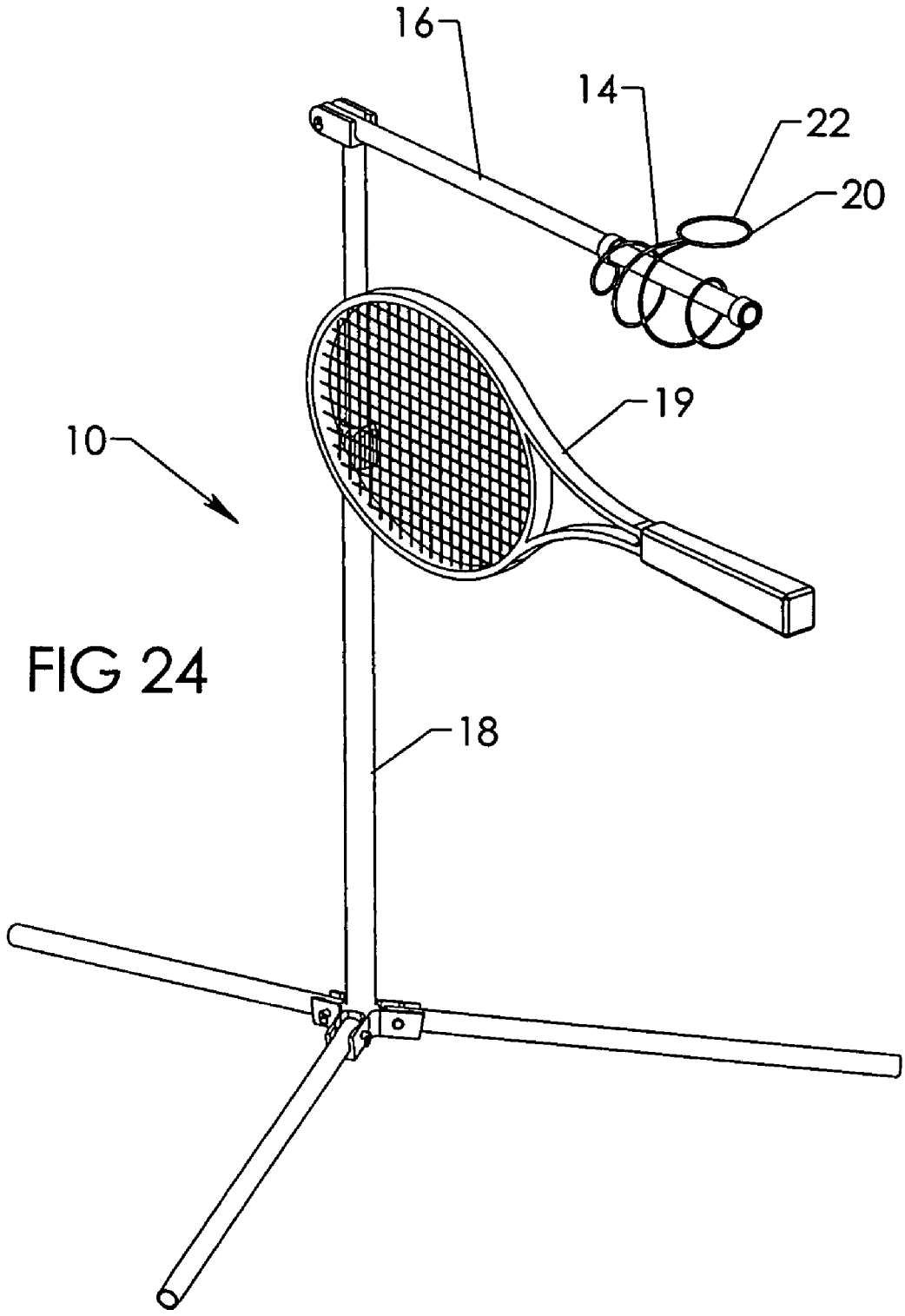
FIG. 24 is a perspective view of the sport ball training device of FIG. 23 with the ball sling winding around a horizontal support arm due to recoil from the racquet impact during the stroke.

As shown in FIG. 24, after the ball 12 has been struck and leaves the ball sling 14, the momentum of the ball sling 14 carries it forward so as to wrap itself around the transverse support arm 16. The ball sling 14 has been wound approximately one and one half rotations at the stopping point with the loop 22 disposed above the transverse support arm 16. At this point, the resilient recoil force stored in the ball sling begins to unwind the sling from the transverse support arm 16 in a process that is essentially the reverse of the sequence of FIGS. 22–24 with the ball sling 14 ending the recoil motion in a vertical hanging position ready to be reloaded with another sport ball 12.

Figure 25:
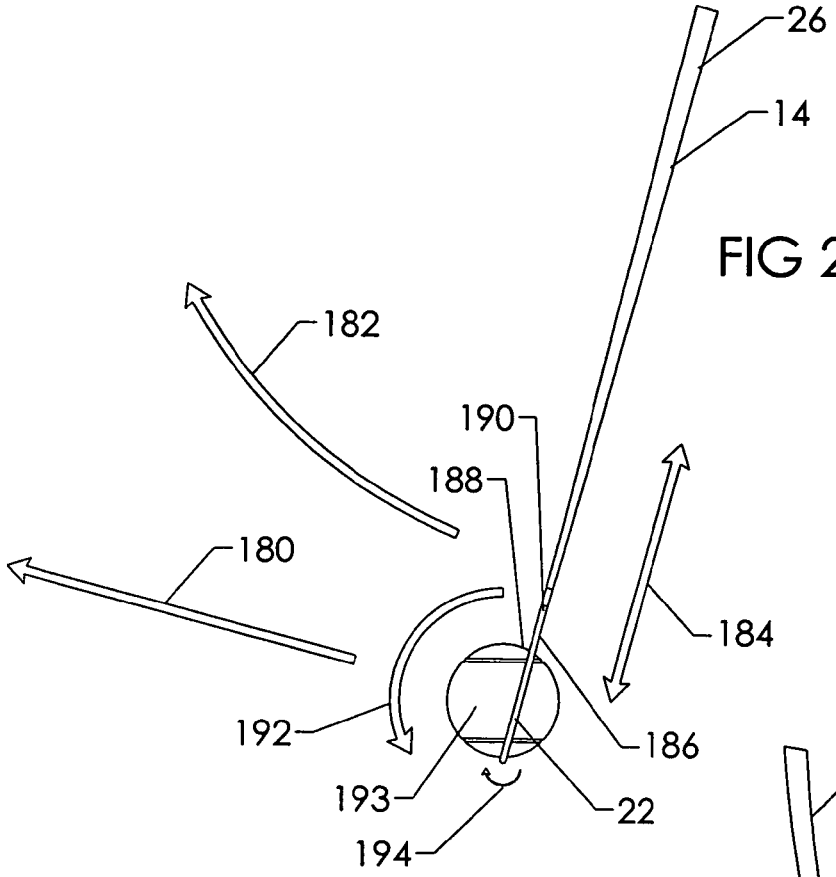
FIG. 25 is a side view of the ball sling of the sport ball training device of FIG. 1 with the sport ball disposed within the ball sling of a sport ball training device after impact from a racquet and indicating by the various arrows the forces and movements of the sport ball and ball sling.
Figure 26:
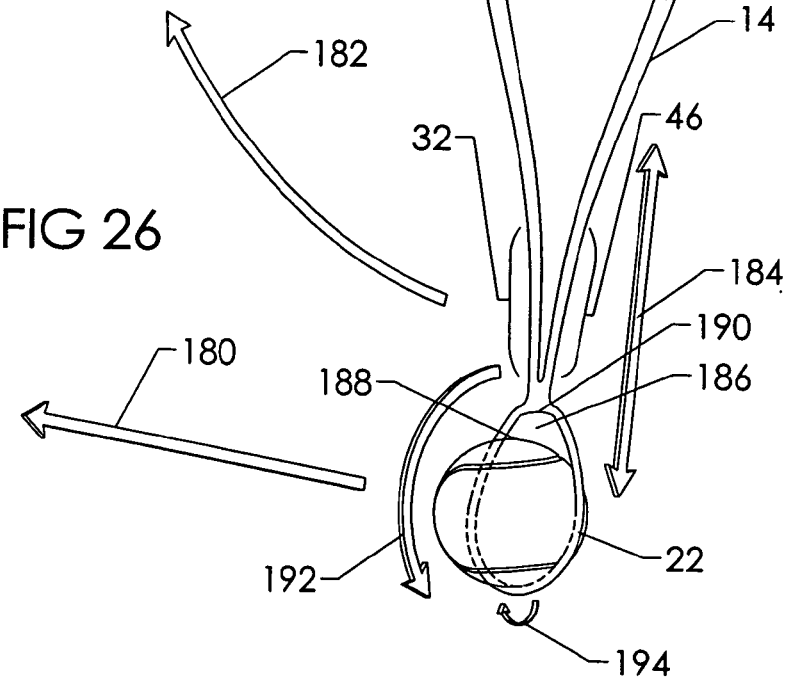
FIG. 26 is a perspective view of the ball sling and sport ball of FIG. 25.

FIGS. 25 and 26 show the ball sling 14 in use with topspin rotation applied to the ball 12 during the stroke. When ball 12 is struck with a racquet 19 that induces spin on the ball 12, the release of the ball 12 from the loop 22 is facilitated. After the ball 12 is struck, the ball 12 and ball sling 14 move forward from their nominal resting vertical position hanging from the support device 18. At this point, the ball is following a flight path direction indicated by arrow 180 and the ball sling 14 is following a curved trajectory indicated by arrow 182, because, as discussed above, the ball sling 14 is secured to the transverse support arm 16 and is confined to a rotational motion. This causes the underside surface of the ball 12 to press against the bottom section of the loop 22 which stretches both the loop 22 in a circumferential orientation and stretches the sling members 24 and 26 in a longitudinal or axial orientation as indicated by arrow 184.

The axial stretching of the sling members 24 and 26 is particularly prevalent in the shock absorbing zones 32 and 46 as this thinner transverse cross section is where the resistance to axial stretch is the lowest. Stretching is also prevalent in the loop 22 where the transverse cross section of the loop element is thin relative to the upper ends 28 and 42 of the sling members 24 and 26. A gap 186 is created or increased between a top surface 188 of the ball 12 and a top portion 190 of the loop 22 as the loop 22 is stretched from the momentum of the ball 12. During this process, the ball 12 is also rotating about its own axis from the force of the racquet as indicated by arrow 192, and begins to move forward with respect to the loop 22, as shown in FIG. 25, such that the center or center of gravity 193 of the ball is no longer aligned with the plane of the loop 22 and ball sling 14. The rotation of the ball 12 also causes a responsive or counter rotation of the portion of the loop 22 which is in contact with the undersides of the ball 12 as indicated by arrow 194 and causes the ball 12 and loop portion in contact with the underside of the ball 12 to roll away from each other. The portion of the loop 22 which is in contact with the underside of the ball 12 has a substantially round transverse cross which is conducive to the inducement of rotation by the ball 12. These forces and effects create an unstable linkage between the ball 12 and loop 22 and the ball 12 thus is squeezed out of the loop 22 as it progresses forward along arrow 180 and the ball sling progresses along the curved trajectory along arrow 182.

Figure 27:
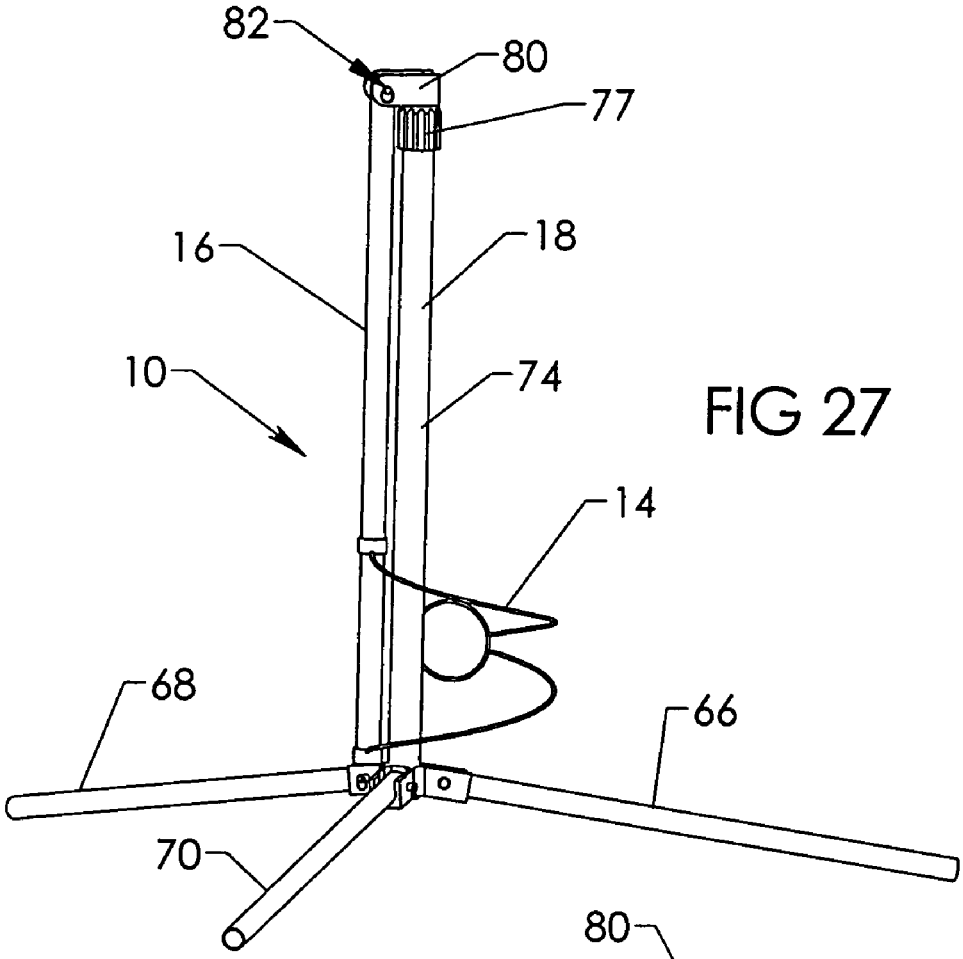
FIG. 27 is a perspective view of an embodiment of the sport ball training device of FIG. 1 partially collapsed for transportation.
Figure 28:
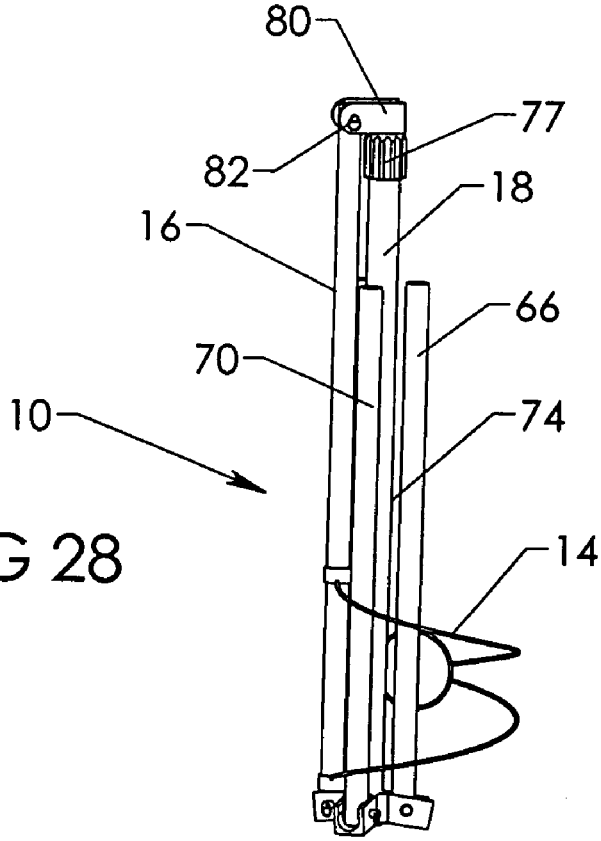
FIG. 28 is a perspective view of the sport ball training device of FIG. 27 fully collapsed for transportation.

FIG. 27 shows a first step in collapsing an embodiment of the sport ball training device 10 of FIGS. 1–4 for transportation. The transverse support arm 16 is rotated 270 degrees about clevis pin 82, which puts it in a vertical position. The locking ring 77 is then released to allow the upper vertical support tube to telescope into the lower vertical support tube 74. FIG. 28 shows the second step in collapsing the device 10 for transportation wherein the support legs 66, 68 and 70 are moved into a vertical position. Both the transverse support arm 16 and the support legs 66, 68 and 70 may be held in position during use by snap lock features of the knuckles 58 and 80 shown in FIGS. 17 & 18.

With regard to the above detailed description, like reference numerals used therein refer to like elements that may have the same or similar dimensions, materials and configurations. While particular forms of embodiments have been illustrated and described, it will be apparent that various modifications can be made without departing from the spirit and scope of the invention. Accordingly, it is not intended that the invention be limited by the forgoing detailed description.

What is claimed is:

1. A sport ball training device, comprising:

a support device; and a ball sling comprising at least one resilient sling member having a first end secured to the support device, a second end, and an increased resistance to bending from the second end to the first end and a retainer member which is secured to the second end of the resilient sling member and which is configured to releasably secure a sport ball.

2. The training device of claim 1 wherein the ball sling is molded in a monolithic structure from a uniform material.

3. The training device of claim 2 wherein the uniform material comprises an elastomer.

4. The training device of claim 3 wherein the elastomer comprises a durometer of about 25 shore A to about 65 shore A.

5. The training device of claim 1 wherein the at least one resilient sling member is comprised of an elastic material and is tapered to a decreased transverse dimension from the first end to the second end.

6. The sport ball training device of claim 1 wherein the at least one resilient sling member has a length of about 12 inches to about 25 inches.

7. The training device of claim 1 wherein the retainer member comprises a loop of resilient elastic material.

8. The training device of claim 7 wherein the resilient elastic material comprises an elastomer.

9. The training device of claim 7 wherein an inner circumference of the loop is about 5 percent smaller to about 5 percent larger than the outer circumference of a sport ball for use with the training device.

10. The training device of claim 7 wherein an inner circumference of the loop is about 3 percent to about 7 percent smaller than the outer circumference of a sport ball for use with the training device.

11. The training device of claim 7 wherein an inner circumference of the loop is about 3 percent to about 7 percent larger than the outer circumference of a sport ball for use with the training device.

12. The training device of claim 7 wherein the loop has an inner circumference of about 8 inches to about 9 inches.

13. The training device of claim 1 wherein the support device comprises a base, a riser tube assembly having a lower end secured to the base, and a transverse support arm secured to and extending radially from an upper end of the riser assembly and wherein the first end of the at least one resilient sling member is secured to the transverse support arm.

14. The training device of claim 13 wherein the transverse support arm is substantially perpendicular to the riser tube assembly.

15. The training device of claim 1 wherein the first end of the at least one resilient sling member is secured directly to the support device.

16. A sport ball training device, comprising a support device; and a ball sling comprising:

a first resilient sling member having an upper end secured to the support device, a lower end, and an increased resistance to bending from the lower end to the upper end, a second resilient sling member having an upper end secured to the support device and a lower end, and a retainer member secured to the lower ends of the resilient sling members and configured to releasably secure a desired sport ball.

17. The sport ball training device of claim 16 wherein the resilient sling members have a length of about 12 inches to about 25 inches.

18. The training device of claim 16 wherein the ball sling is molded in a monolithic structure from a substantially uniform material.

19. The training device of claim 18 wherein the single material comprises an elastomer.

20. The training device of claim 16 wherein the retainer member comprises a loop of resilient elastic material.

21. The training device of claim 20 wherein an inner circumference of the loop is about 5 percent smaller to about 5 percent larger than the outer circumference of a sport ball for use with the training device.

22. The training device of claim 16 wherein the support device comprises a base, a riser tube assembly having a lower end secured to the base, and a transverse support arm secured to and extending radially from an upper end of the riser assembly and wherein the first end of the at least one resilient sling member is secured to the transverse support arm.

23. The training device of claim 16 wherein the upper ends of the resilient sling members are secured directly to the support device.

24. A sport ball training device, comprising a support device; and a ball sling comprising:

a first resilient sling member having an upper end secured to the support device, a lower end and an increased resistance to bending from the lower end to the upper end, a second resilient sling member having an upper end secured to the support device, a lower end and an increased resistance to bending from the lower end to the upper end, and a retainer member secured to the lower ends of the resilient sling members configured to releasably secure a desired sport ball.

25. A sport ball training device, comprising:

a support device; and a ball sling comprising at least one resilient sling member having a first end secured to the support device, a second end and a retainer member secured to the second end of the at least one resilient sling member comprising a loop with an elongate loop element having a substantially round cross section at a bottom portion of the loop and configured to be induced to rotation by rotation of a sport ball in the loop.

26. The training device of claim 25 wherein the loop of the retainer member comprises a resilient elastic material.

27. The training device of claim 25 wherein the resilient elastic material comprises an elastomer.

28. The training device of claim 25 wherein an inner circumference of the loop is about 5 percent smaller to about 5 percent larger than the outer circumference of a sport ball for use with the training device.

29. The training device of claim 25 wherein an inner circumference of the loop is about 3 percent to about 7 percent smaller than the outer circumference of a sport ball for use with the training device.

30. The training device of claim 25 wherein an inner circumference of the loop is about 3 percent to about 7 percent larger than the outer circumference of a sport ball for use with the training device.

31. The training device of claim 25 wherein the loop has an inner circumference of about 8 inches to about 9 inches.

32. The training device of claim 25 wherein the ball sling is molded in a monolithic structure from a uniform material.

33. The training device of claim 32 wherein the uniform material comprises an elastomer.

34. The training device of claim 33 wherein the elastomer comprises a durometer of about 25 shore A to about 65 shore A.

35. The training device of claim 25 wherein the at least one resilient sling member has an increased resistance to bending from the second end to the first end.

36. The training device of claim 35 wherein the sling member is comprised of an elastic material and is tapered to a decreased transverse dimension from the first end to the second end.

37. The sport ball training device of claim 25 wherein the at least one resilient sling member has a length of about 12 inches to about 25 inches.

38. The training device of claim 25 wherein the support device comprises a base, a riser tube assembly having a lower end secured to the base, and a transverse support arm secured to and extending radially from an upper end of the riser assembly and wherein the first end of the at least one resilient sling member is secured to the transverse support arm.

39. The training device of claim 38 wherein the transverse support arm is substantially perpendicular to the riser tube assembly.

40. The training device of claim 25 wherein the first end of the at least one resilient sling member is secured directly to the support device.

41. A ball sling for a sport ball training device, comprising at least one resilient sling member having a first end, a second end, and an increased resistance to bending from the second end to the first end and a retainer member which is secured to the second end of the resilient sling member and which is configured to releasably secure a sport ball.

42. The ball sling of claim 41 wherein the ball sling is molded in a monolithic structure from a uniform material.

43. The ball sling of claim 42 wherein the uniform material comprises an elastomer.

44. The ball sling of claim 43 wherein the elastomer comprises a durometer of about 25 shore A to about 65 shore A.

45. A ball sling molded in a monolithic structure from a uniform material comprising at least one resilient sling member having a first end, a second end and a retainer member secured to the second end of the at least one resilient sling member comprising a loop with an elongate loop element having a substantially round cross section at a bottom portion of the loop and configured to be induced to rotation by rotation of a sport ball in the loop.

46. The ball sling of claim 45 wherein the uniform material comprises an elastomer.

47. The ball sling of claim 46 wherein the elastomer comprises a durometer of about 25 shore A to about 65 shore A.

* * * * *